US005390451A

United States Patent [19]

Kopp et al.

[11] Patent Number: 5,390,451

[45] Date of Patent: Feb. 21, 1995

[54] FLEXIBLE HIGH COLLAR ROOF FLASHING

[75] Inventors: Raun A. Kopp, Brunswick; Roberto Rodriguez, Cleveland, both of Ohio

[73] Assignee: Oatey Co., Cleveland, Ohio

[21] Appl. No.: 939,716

[22] Filed: Sep. 2, 1992

[51] Int. Cl.[6] ..... F04D 1/36

[52] U.S. Cl. ..... 52/58; 52/60; 52/198; 285/43

[58] Field of Search ..... 52/58, 60, 198, 199, 52/244; 285/42, 43, 44

[56] References Cited

U.S. PATENT DOCUMENTS

| | | | |
|---|---|---|---|
| 1,287,235 | 12/1918 | Cole . | |
| 1,615,929 | 2/1927 | Buckles et al. . | |
| 3,098,663 | 7/1963 | Dibley . | |
| 3,313,559 | 4/1967 | Kifer . | |
| 3,636,880 | 4/1969 | Kifer | 52/58 |
| 3,977,137 | 8/1976 | Patry | 52/60 |
| 4,010,578 | 3/1977 | Logsdon | 52/58 |
| 4,160,347 | 7/1979 | Logsdon | 52/199 |
| 4,265,058 | 5/1981 | Logsdon | 52/58 |
| 4,526,407 | 7/1985 | Kifer | 285/42 |
| 4,652,321 | 3/1987 | Greko | 52/58 |

FOREIGN PATENT DOCUMENTS

| | | | |
|---|---|---|---|
| 0203681 | of 1920 | Canada | 52/58 |
| 1355517 | 6/1974 | United Kingdom | 52/219 |

OTHER PUBLICATIONS

Aztek Washer Company catalog titled MASTER FLASH ® Universal Pipe Flashing System, copyright 1991.

*Primary Examiner*—Carl D. Friedman
*Assistant Examiner*—Winnie Yip
*Attorney, Agent, or Firm*—Renner, Otto, Boisselle & Sklar

[57] ABSTRACT

A roof flashing for sealing an opening in a roof through which an upstanding pipe extends includes a base member having an opening for passage of the pipe and a collar attached to the base member surrounding the opening in the base member for receipt of the pipe when the base member is attached to the roof. The collar has corrugations which permit the collar to be expanded and compressed to different lengths to accommodate different length pipes within the collar. The corrugations at the outer end of the collar are flattened out to facilitate folding of the outer end over an upper end of the pipe to form a watertight seal between the collar and pipe.

13 Claims, 2 Drawing Sheets

FLEXIBLE HIGH COLLAR ROOF FLASHING

FIELD OF THE INVENTION

This invention relates generally to a roof flashing having a flexible high collar for sealing a pipe protruding from the roof of a building.

BACKGROUND OF THE INVENTION

There are many different types of roof flashings used to seal openings around pipes extending through the roofs of buildings that have met with varying degrees of success. Many roof flashings include elastomeric collars to form the seal around the pipes. However, roof flashings with elastomeric collars are not recommended for use in tarred roof environments because the tar attacks the elastomeric material and may cause premature leakage.

Accordingly, lead roof flashings are most commonly used to seal pipes protruding from tarred roofs. However, the lead flashings are a potential health hazard because of possible contamination to the run-off water which comes into contact with the lead. Also, lead flashings are relatively expensive and much more bulky than most other flashings, and are more susceptible to damage, making them more difficult and costly to ship and install.

SUMMARY OF THE INVENTION

The present invention provides a roof flashing that does not include any lead and will not prematurely deteriorate when installed on a tarred roof and the like. Also, the roof flashing of the present invention is relatively inexpensive and light in weight in comparison to a lead flashing, and is not as easily damaged during shipment or installation. Moreover, the roof flashing of the present invention includes a collar that can be compressed to make it more compact so that it takes up less room during shipment and storage, and both the height and angle of the collar can be easily adjusted to fit different length pipes and different pitch roofs.

In accordance with one aspect of the invention, the roof flashing includes a spiral wound corrugated flexible collar, the angle and length of which may be adjusted to fit different length pipes and different pitch roofs.

In accordance with another aspect of the invention, the corrugations in the outer end of the collar are flattened out to facilitate folding of such outer end over the exposed end of the pipe.

In accordance with another aspect of the invention, one end of the corrugated collar is desirably received in an upwardly facing groove surrounding an opening in the base portion of the roof flashing and crimped in place to provide a permanent connection therebetween.

In accordance with another aspect of the invention, a channel shaped gasket may be disposed in the upwardly facing groove in the base member of the roof flashing before inserting one end of the collar into the groove and crimped in place to form a fluid tight seal therebetween.

In accordance with another aspect of the invention, the gasket may include an annular flange portion extending radially inwardly into the opening in the base portion to form a secondary seal with the pipe extending therethrough.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
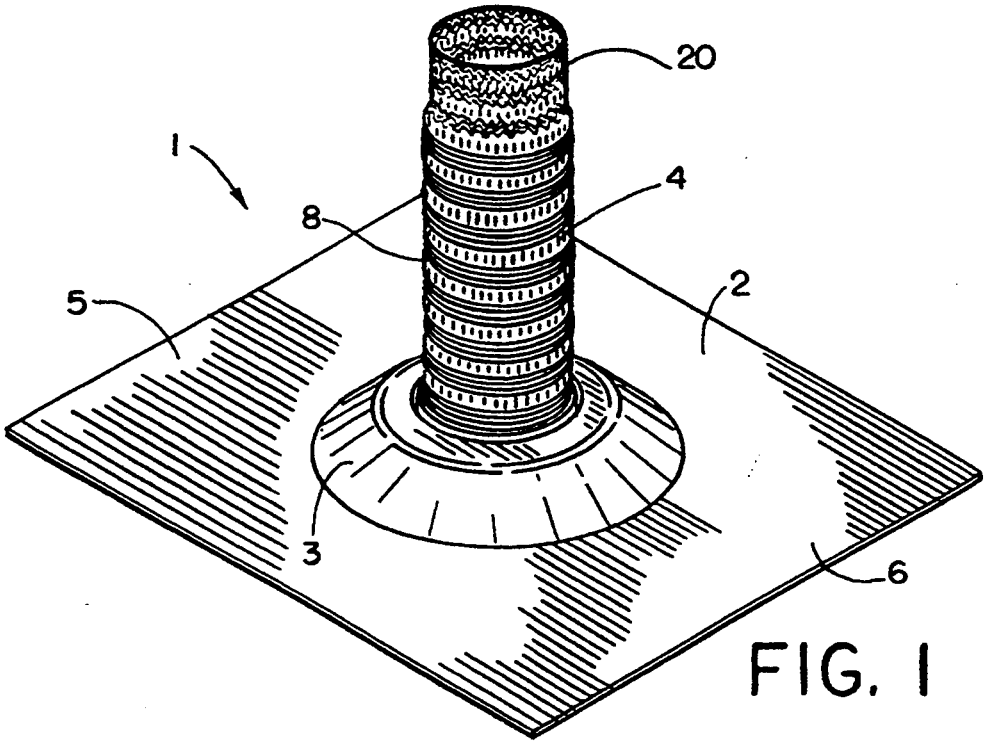
FIG. 1 is a perspective view of a preferred form of roof flashing in accordance with this invention including an expandible/compressible spiral wound corrugated flexible collar shown substantially fully compressed.

Referring now in detail to the drawing, and initially to FIG. 1, a preferred form of roof flashing in accordance with this invention is generally indicated at 1 and includes a generally flat, rectangular base member 2 having a raised dome portion 3 to which a unitary one piece spiral wound corrugated flexible collar 4 is attached as described hereafter.

Figure 2:
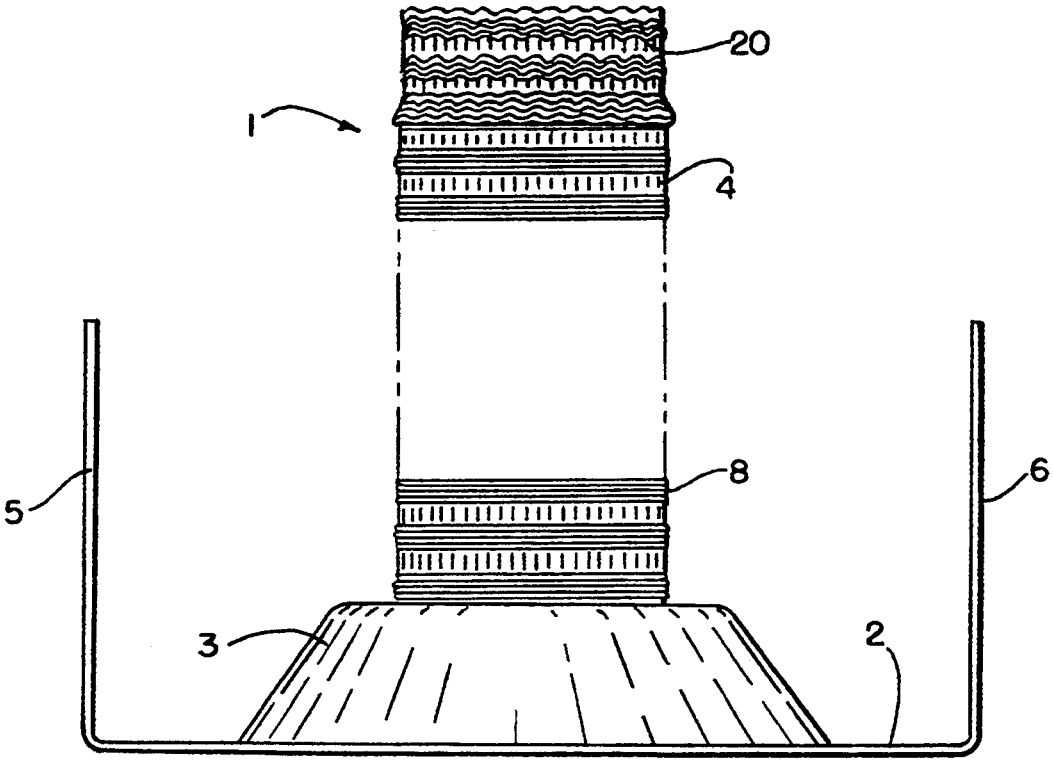
FIG. 2 is an enlarged side elevation view of the roof flashing of FIG. 1 but showing opposite ends of the base member bent upwardly adjacent opposite sides of the dome portion.

Preferably, the base member 2 is made of dead soft aluminum sheet which is malleable for ease of bending to conform to any roof surface, and, if desired, to permit the ends 5, 6 of the base member to be folded up adjacent opposite sides of the dome portion 3 as schematically shown in FIG. 2 to make the roof flashing more compact so it takes up less room during shipment and storage. However, it should be understood that the base portion could be made of other metals such as galvanized steel if desired.

The collar 4 is preferably made of spiral wound corrugated aluminum, which may be oxidized or dulled so it won't reflect much light and thus won't be very noticeable when installed on a roof. The spiral wound corrugations 8 not only allow the collar to flex to receive pipes when the flashing is installed on roofs having different pitches, for example, from flat to 45°; but also allow the collar to be compressed as schematically shown in FIGS. 1 and 2 to reduce the height of the collar during shipment and storage of the roof flashing, and elongated to fit different heights (protruding lengths) of pipes. This is a great advantage over lead flashings which have to be custom-made to fit the particular height of the pipe and pitch of the roof with which the flashing is to be used.

Figure 3:
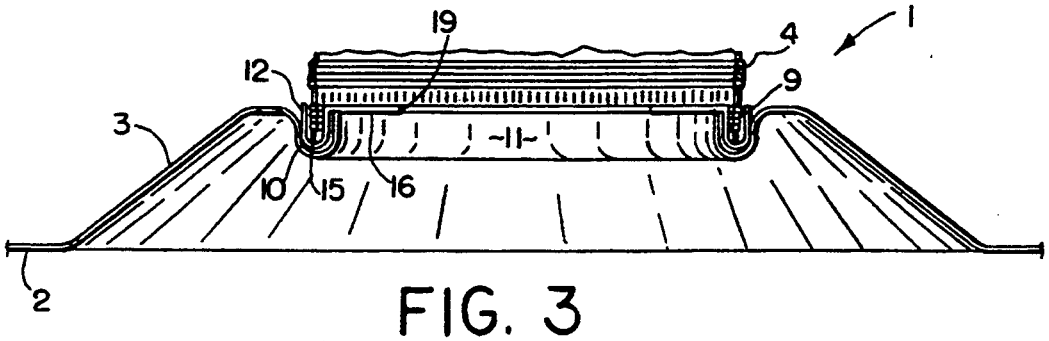
FIGS. 3 and 4 are enlarged fragmentary longitudinal sections progressively showing how the collar portion of the roof flashing is joined to the base member.
Figure 4:
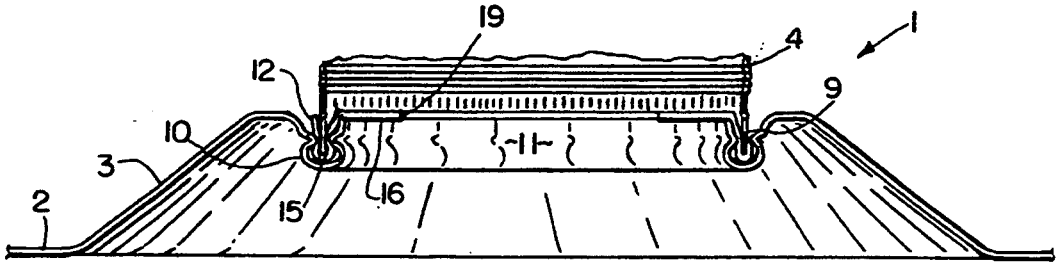

The lower end 9 of the collar 4 is desirably attached to the base member 2 by inserting such lower end in an upwardly facing groove 10 surrounding an opening 11 in the dome 3 as schematically shown in FIG. 3 and then crimped in place as schematically shown in FIG. 4. Alternatively, the collar 4 may be soldered to the base. However, since soldering is more expensive, crimping is preferred.

Figure 6:
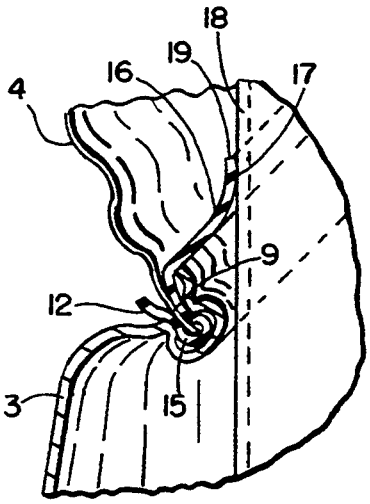
FIG. 6 is an enlarged fragmentary longitudinal section through the joint between the collar and base member of the roof flashing, which includes a gasket that forms a secondary seal with the pipe extending upwardly through the base member into the collar.

Also, a separate gasket 12 is desirably placed in the groove 10 before the lower end of the collar 4 is inserted and crimped in place to provide a fluid tight seal therebetween. In the preferred embodiment disclosed herein, the gasket 12 includes a generally U-shape channel portion 15 in which the bottom edge of the collar is received, and a generally radially inwardly directed flange 16 which forms a secondary seal 17 with a pipe 18 extending through an opening 19 in the flange as schematically shown in FIG. 6. The collar and base member protect the gasket against exposure to the elements and attack by tarred roofs and the like for increased life. In the event a secondary seal should be deemed unnecessary, the gasket 12 could be eliminated altogether and the crimping between the bottom edge of the collar and the groove be relied upon to eliminate any leakage therebetween, or a simpler gasket or caulk or other sealant could be placed in the groove to provide a fluid tight seal thereat.

Although the size of the opening 11 in the dome 3 and inner diameter of the collar 4 may vary, both must be large enough to permit passage of the pipe 18 therethrough when the roof flashing 1 is properly installed on the roof of a building. As a general rule, the inner diameter of the collar 4 is desirably made to be approximately one-half inch greater than the outer diameter of the pipe.

Likewise, both the minimum and maximum lengths of the collar 4 between its fully compressed and fully extended conditions may vary depending on the different protruding lengths of pipe to be sealed thereby. As a general rule, the fully extended length of the expandible/compressible portion of the collar may be about four times its fully compressed length. Thus, if the fully compressed length of the expandible/contractible portion of the collar is approximately four inches, then its fully extended length is approximately sixteen inches, and so on.

At the upper or outer end 20 of the collar 4 the corrugations are flattened out for a portion of the length of the collar, for example, one to two inches, to provide corrugations at the upper end of the collar which are of less height than the other corrugations, as by passing the outer end of the collar between a pair of rotating gears. This makes it easier to fold the flattened outer end 20 of the collar 4 over the upper end of the pipe and into the pipe opening as described hereafter.

For shipment and storage of the flashing 1, the collar 4 may be substantially fully compressed as schematically shown in FIGS. 1 and 2. Also, the ends 5, 6 of the base member 2 may be folded up adjacent opposite sides of the dome 3 as further schematically shown in FIG. 2 so that the flashing takes up less width during shipment and storage.

To install the roof flashing 1, the base member 2 and collar 4 are inserted over the top of the pipe 18 and the base portion is bent to conform to the roof surface 21 and secured in place using suitable fasteners (not shown). If the roof 21 is pitched, the collar 4 is flexed, (i.e., expanded or contracted on one side relative to the other) to bring the axis of the collar substantially in line with the axis of the pipe 18 as schematically shown in FIG. 5.

Providing the base member 2 with a dome 3 allows the pipe 18 to extend through the opening 11 in the dome without interference with the circumference of the opening when installed on roofs from flat up to a 45° pitch. Also, the dome has the further advantage of keeping standing water on flat roofs away from the joint between the collar and base member. However, it should be understood that the dome could be eliminated and the collar attached to a substantially flat base member around an opening therein if desired.

Figure 5:
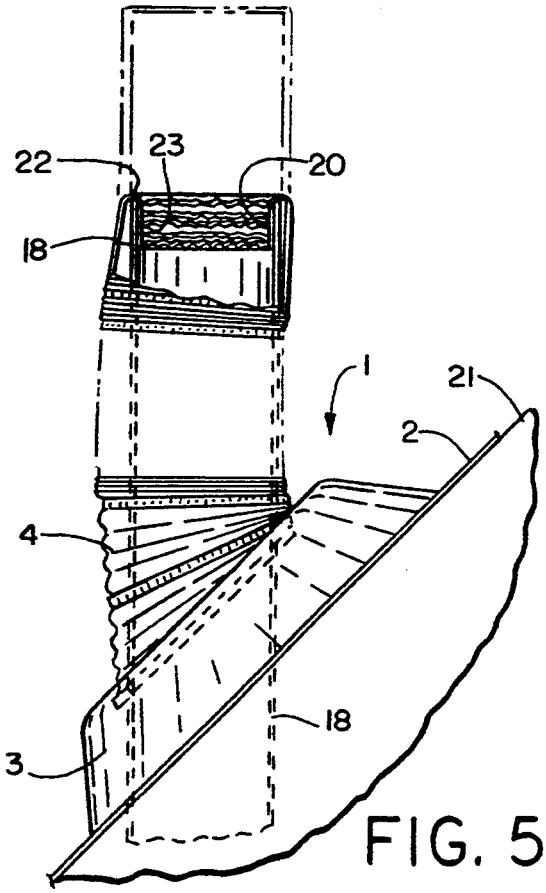
FIG. 5 is a side elevation view schematically showing the roof flashing in the installed condition on a sloping roof.

After the base member 2 has been suitably secured to the roof 21, the collar 4 may be expanded to the extent necessary to permit the flattened upper end 20 of the collar to be folded over the top 22 of the pipe 18 and into the pipe opening 23 as schematically shown in FIG. 5. As an example, the expandible/compressible portion of the collar 4, when fully compressed, may have a length of approximately four inches, and when expanded, a length up to approximately sixteen inches. Since the dome portion 3 of the roof flashing 1 extends above the roof approximately two inches, a roof flashing of these dimensions can be used to seal pipes that protrude beyond a roof anywhere from approximately six inches to approximately eighteen inches.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A roof flashing comprising a base member having an opening therethrough, and a unitary one piece corrugated metal collar means having a lower end secured to said base member around said opening and an upper end, said collar means being expandable and compressible to different lengths, said collar means having corrugations over a substantial portion of the length of said collar means including said upper end, said corrugations at said upper end being flattened out to provide corrugations at said upper end which are of less height than the remaining corrugations of said collar means for ease of folding of said upper end over an upper end of a pipe extending through said opening in said base member and into said collar means to provide a watertight seal between said collar means and the upper end of the pipe.

2. The roof flashing of claim 1 wherein said upper end of said corrugated metal collar means is crimped within an outwardly facing groove in said base member surrounding said opening.

3. The roof flashing of claim 2 further comprising separate seal means providing a watertight seal between said lower end of said corrugated metal collar means and said base member.

4. The roof flashing of claim 3 wherein said seal means comprises a gasket within said groove.

5. The roof flashing of claim 4 wherein said gasket includes flange means extending radially inwardly into said opening in said base member for providing a watertight seal with a pipe extending through said opening and into said collar means.

6. The roof flashing of claim 1 wherein said base member is made of a malleable metal to facilitate folding opposite ends of said base member up adjacent opposite sides of said collar means to make said roof flashing more compact during shipment and storage of said roof flashing.

7. The roof flashing of claim 6 wherein said collar means is compressed lengthwise to make said roof flashing more compact during shipment and storage of said roof flashing.

8. A roof flashing in combination with an upstanding pipe extending through an aperture in a roof, said roof flashing comprising a base member adapted to be secured to the roof, said base member having an opening for passage of the pipe through said base member, and a collar having a lower end attached to said base member surrounding said opening in said base member for receipt of the pipe when said base member is attached to the roof, said collar comprising a unitary one piece collar including corrugations permitting expansion and compression of said collar to different lengths to accommodate different length pipes within said collar, and primary seal means for forming a watertight seal between said collar and an upper end of the pipe, said primary seal means comprising an upper end of said collar folded over the upper end of the pipe, said upper end of said collar also including corrugations which have been flattened out to reduce the height of said corrugations in said upper end of said collar for ease of folding said upper end of said collar over the upper end of the pipe.

9. The roof flashing of claim 8 further comprising separate secondary seal means adjacent a lower end of said collar for forming a secondary seal between said roof flashing and the outer diameter of the pipe.

10. The roof flashing of claim 9 wherein said lower end of said collar is crimped within an outwardly facing groove in said base member surrounding said opening, said groove containing a gasket providing a watertight seal between said lower end of said collar and said base member, and said secondary seal means comprising flange means extending radially inwardly from said gasket into said opening in said base member for forming a watertight seal with the outer diameter of the pipe extending through said opening in said base member and into said collar.

11. The roof flashing of claim 10 wherein said base member includes a raised dome portion containing said opening in said base member, said lower end of said collar being secured to said dome portion around said opening in said base member.

12. The roof flashing of claim 8 wherein said collar is made of metal.

13. The roof flashing of claim 12 wherein said base member is made of a malleable metal to facilitate folding opposite ends of said base member up adjacent opposite sides of said collar and said collar is compressed lengthwise to make said roof flashing more compact during shipment and storage.

* * * * *